US005379964A

United States Patent [19]

Pretto et al.

[11] Patent Number: 5,379,964

[45] Date of Patent: Jan. 10, 1995

[54] COMPOSITE EXPANDABLE SHAFT

[75] Inventors: Alessio G. Pretto, Pawling, N.Y.; Louis J. Keester; Richard S. Hansen, both of Lincoln, Nebr.

[73] Assignees: Addax, Inc., Lincoln, Nebr.; Goldenrod, Inc., Prospect, Conn. ; a part interest

[21] Appl. No.: 103,900

[22] Filed: Aug. 10, 1993

[51] Int. Cl.[6] ..... B65H 75/24

[52] U.S. Cl. ..... 242/571.2

[58] Field of Search ..... 242/72 R, 72 B, 571.2; 279/2.07, 2.08

[56] References Cited

U.S. PATENT DOCUMENTS

| | | | |
|---|---|---|---|
| 3,493,189 | 2/1970 | Slay | 242/72 B |
| 3,552,672 | 1/1971 | Grettve | 242/72 B |
| 3,904,144 | 9/1975 | Gattrugeri | 242/72 B |
| 3,988,103 | 10/1976 | Hoffmeister | 242/72.1 X |
| 4,473,195 | 9/1984 | Marin | 242/72 B |
| 4,502,703 | 3/1985 | Röhm | 242/72 B |

*Primary Examiner*—John M. Jillions
*Assistant Examiner*—John P. Darling
*Attorney, Agent, or Firm*—Edward R. Hyde

[57] ABSTRACT

An expandable shaft of the slotted type made of a fiber and resin composite material. The shaft is fabricated by first forming the central cylindrical core and then forming the rails by pultrusion. The rails are then bonded to the outer surface of the core.

9 Claims, 2 Drawing Sheets

COMPOSITE EXPANDABLE SHAFT

BACKGROUND OF THE INVENTION

1. Field of the Invention

The present invention relates to drive mandrels or shafts for gripping the internal surfaces of sleeves or tubes on which web material may be wound.

In the winding and rewinding of web material such as paper, cloth and other sheet material, the web is wound on a sleeve or tube having an inside diameter slightly larger than the shaft on the winding mechanism. In this manner the sleeve may readily be slipped on and off the shaft. As a result an arrangement must be provided to effect a secure driving connection between the shaft and sleeve upon which the web material is wound. Accordingly there exists shafts that are expandable to grip against the web sleeve to provide a secure driving engagement.

The present invention is directed to such expandable shafts and the method of making them that provides functional and structural advantages over present expandable shafts.

2. Description of the Prior Art

Expandable shafts or mandrels are generally constructed with elements on the surface adapted to be extended radially outward by inflation of bladders within the shaft. Shaft designs fall into two general categories, the lug type and slotted rail type. The former contemplates a number of discreet lugs located at different points along the shaft. Customarily there is one or more bladders located within the shaft that are appropriately inflated to cause the lugs to extend radially outward to grip the web sleeve that surrounds the shaft. The slotted type of expandable shaft customarily includes a plurality of equally spaced slots around the circumference of the shaft and elongated pressure elements located within the slots. Individual bladders located within the shaft slots are inflated to bear against the pressure elements and extend them radially outward for the gripping of a surrounding web sleeve.

Examples of these prior art shafts are shown in U.S. Pat. Nos. 3,493,189; 3,552,672; 3,904,144 and 4,473,195.

These expandable shafts of the prior art are customarily made of aluminum extrusions or machined steel cylinder bodies having steel end journals. The machined steel cylinder bodies are used to support the larger weight and the higher stiffness applications. The weight of these steel expandable shafts is often excessive and frequently outside the current OSHA weight limits for lifting by individuals without mechanical assistance. The aluminum shafts on the other hand, are limited to lighter weights and less stiffness dependent applications. These are some of the disadvantages of prior art expandable shafts that the present design serves to overcome.

SUMMARY OF THE INVENTION

The expandable shaft of the present invention is of the slotted type employing fiber reinforced composite materials. Shafts of such materials have considerable advantages over the metallic shafts of the prior art. In particular, they have a higher specific stiffness, higher specific strength and are of considerably lighter weight than the steel and aluminum shafts that are in current use.

The shafts of the present invention can take various forms and in a preferred embodiment a hollow core is formed of carbon fiber composite material by any one of a number of processes such as filament winding or roll wrapping. The plurality of elongated rails are formed preferably by pultrusion in which the resin and fibers are pulled through a suitable shaping die resulting in substantially parallel fibers running the length of the elongated rail which is of the desired uniform cross section. The rails are then bonded to the central core in spaced relationship to form elongated slots between adjacent rails. Within each slot there is located a pressure member and an elongated bladder which when inflated serves to extend the pressure member outwardly. The unit is completed by appropriate end journals and a fluid conduit arrangement for bladder inflation.

Accordingly, it is a primary object of the present invention to provide an expandable shaft of the slotted type that is formed of a fiber reinforced material to provide desirable physical characteristics of weight, stiffness and strength.

It is another object of the present invention to provide a method of making an expandable slotted shaft of fiber reinforced composite material.

It is a still further object of the present invention to provide an expandable slotted shaft of a design that is efficient in operation and has advantageous mechanical characteristics.

BRIEF DESCRIPTION OF THE DRAWINGS

The foregoing and still other objects and advantages of the present invention will be more apparent from the following detailed explanation of the preferred embodiments of the invention considered in connection with the accompanying drawings herein in which.

DESCRIPTION OF THE PREFERRED EMBODIMENT

Figure 1:
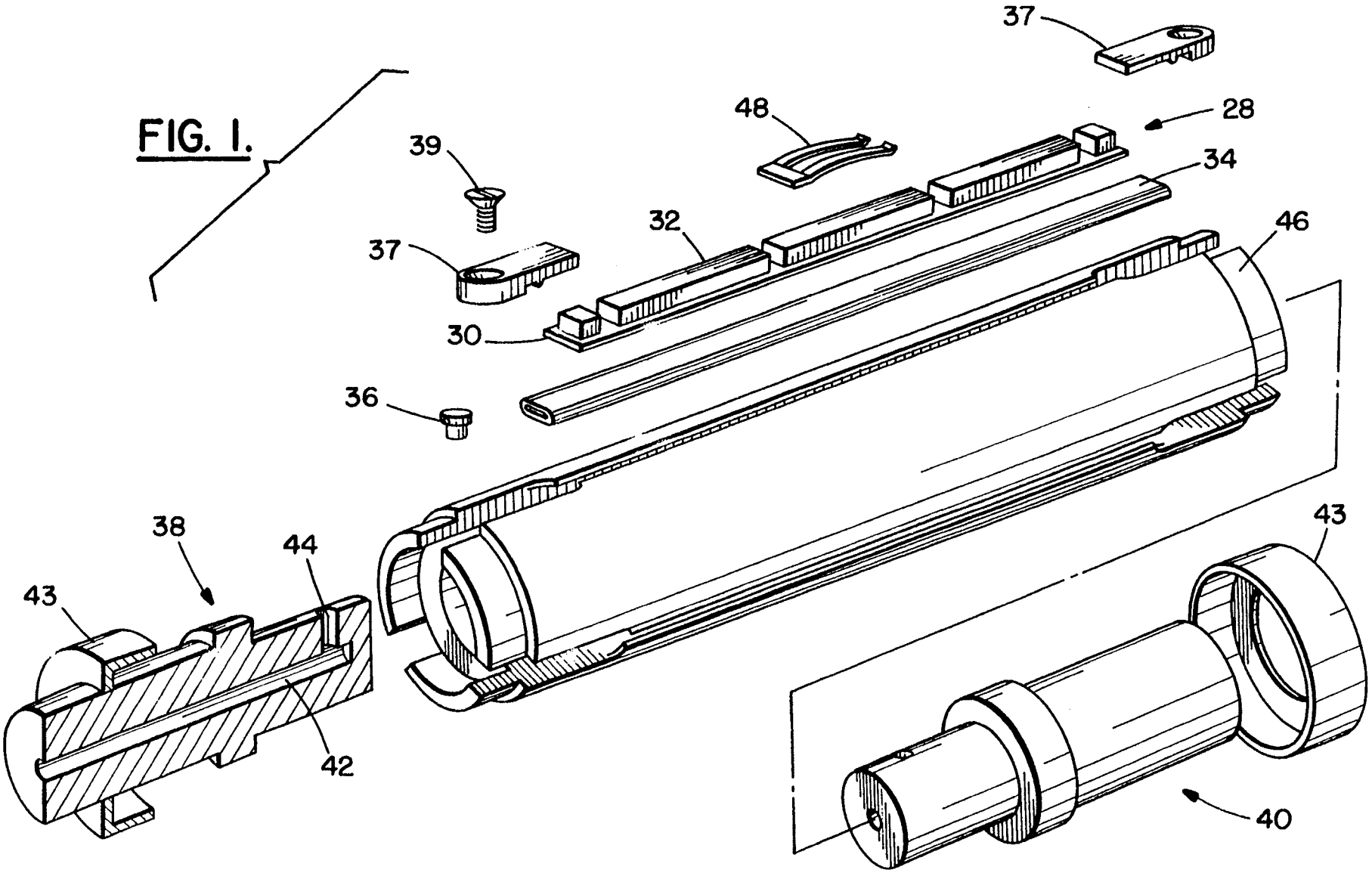
FIG. 1 is an exploded view of an expandable shaft of the present invention.
Figure 2:
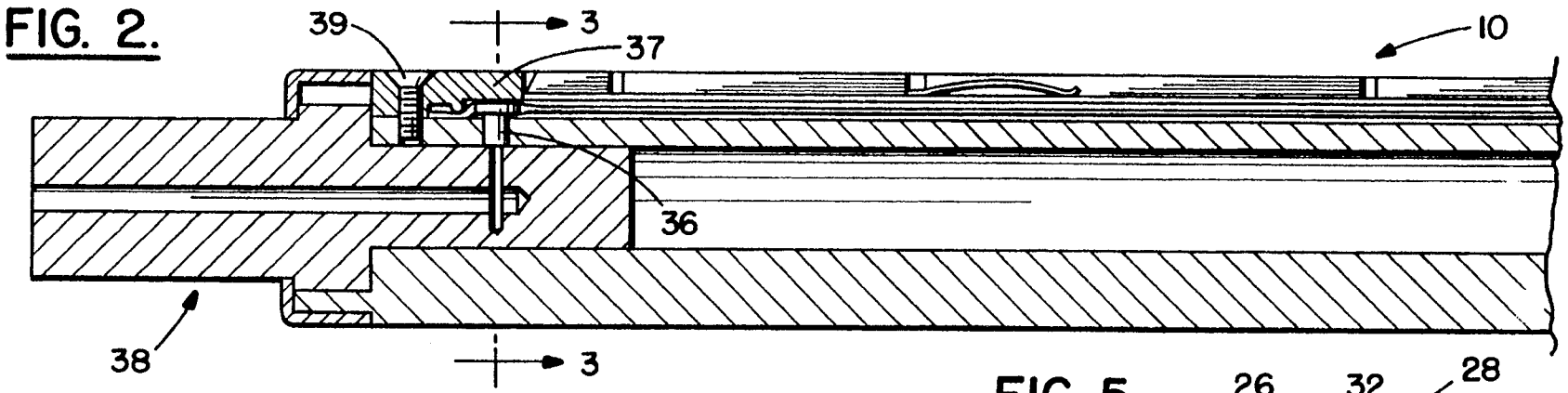
FIG. 2 is a sectional view of the shaft of FIG. 1.

Referring now to the drawings the expandable shaft is generally shown as 10 and includes a central core 12 and a plurality of rails 14, 16 and 18 which are bonded to the core and equally spaced circumferentially to provide spaced slots 20, 22 and 24. Each rail is, of course, of arcuate cross section to conform to the cylindrical core and has a lip 26 along each elongated edge running the length of the rail.

The core 12 is preferably made from a continuous reinforcing fiber and a polymer matrix and may be fabricated in any one of a known manner such as filament winding, hand lay-up or roll wrapping. As a result of this type of fabrication, the fibers are at various angles throughout the length of the core to provide high resistance to torsional deflection of the core.

Composite materials are well known and consist of two or more substances that, unlike the metals of an alloy, remain differentiated within the combined material. In the composite used herein, a reinforcing fiber of carbon or glass is embedded in a polymer matrix material. A thermoset or thermoplastic resin serves as the matrix material.

The high strength and stiffness of carbon fibers combined with their low density provides composites with ten times the specific tensile strength of steel and aluminum, and approximately four times the specific modulus. Furthermore, the unique combination of carbon fiber properties provides composites with significant mechanical benefits overall when compared with fiberglass, ceramic and Kevlar fibers.

Two types of fibers and their properties suitable for the present shaft are the following:

| Fiber Type | Strength (KSI) | Modulus (MST) | Density (Lb/in$^3$) | Area (in) | Elong. % | Filament Diameter |
|---|---|---|---|---|---|---|
| High Strain | 600 | 33.0 | 0.065 | $6.89 \times 10^{-4}$ | 1.8 | 6.9 Microns |
| High Modulus | 550 | 50.0 | 0.067 | $6.24 \times 10^{-4}$ | 1.1 | 6.9 Microns |

The rails are individually made, preferably by the pultrusion method. This results in the fibers extending substantially parallel throughout the length of each rail which is a particularly important feature of the present invention. It has been found that this provides the desirable stiffness for the completed expandable shaft. After the rails are formed they are bonded to the core by a suitable adhesive bonding material extending the full length of the central core. The rails are of constant cross section and although three are shown in the drawings providing three grooves, a greater number of rails may be used resulting in a larger number of grooves.

An important aspect of the present invention is the method of fabricating the shaft. Slotted expandable shafts of the steel type are commonly formed of a single unitary steel element which is machined to provide appropraite slots. To do this with a composite shaft, as herein described, would be difficult and expensive. Such a process with a composite shaft would require special high speed tools with diamond edges which would tend to degrade the structural properties of composites. Aluminum shafts are usually extruded, a process that is not applicable to composite materials.

Thus, the preferred method of the present invention as described above contemplates forming the rails separately from the core and then bonding them together.

An alternative method of fabrication avoiding the problems of composite maching would be to form the core and rails as a unitary element.

Located within each groove is a pressure member generally indicated by 28 which consists of a flat base element 30 and a series of rubber pads 32 that are bonded to the strip 30. The pressure member 28 thus comprises an elongated, inverted T and when located within the slot, the outer edges of the strip 30 are located under rail lips 26 as more clearly seen in FIG. 6.

Located under each pressure member 28 is an inflatable bladder 34 made of a suitable flexible material such as rubber. A metal fixture 36 having an opening is fitted in the underside of one end of each bladder whereby air or other fluid can be passed into the bladder for inflation. The ends of the bladders are sealed by clamps 37 secured in place by machine screws 39 received in the core.

A pair of end journals 38 and 40 are provided at the two ends of the shaft for suitable mounting. Journal 38 has an axial bore 42 and a plurality of radial bores 44 to connect the pneumatic source with the individual bladder inlet fixture 36. A collar 44 surrounding each journal fits over the reduced ends 46 of the shaft 10. A series of U-shaped leaf springs 48 are located in each slot above the respective strip 30 and below the lips 26 of the rails. The purpose of the leaf springs is to urge the pressure member 28 radially inward when its respective bladder is deflated.

Figure 5:
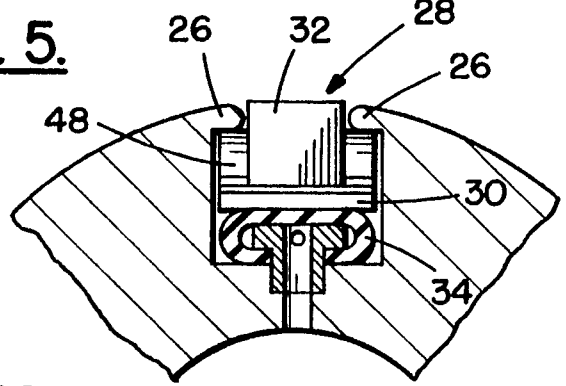
FIG. 5 is a detailed view of a cross section of a single slot with the bladder deflated.
Figure 6:
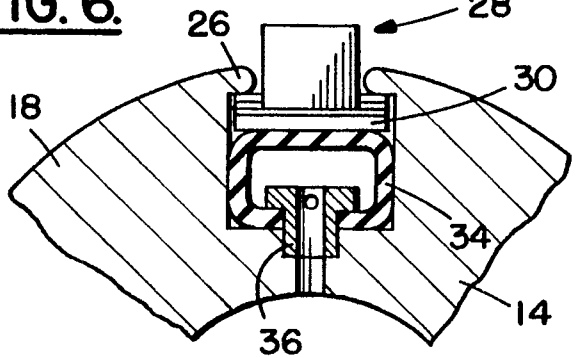
FIG. 6 is a view similar to FIG. 5 with the bladder expanded.
Figure 4:
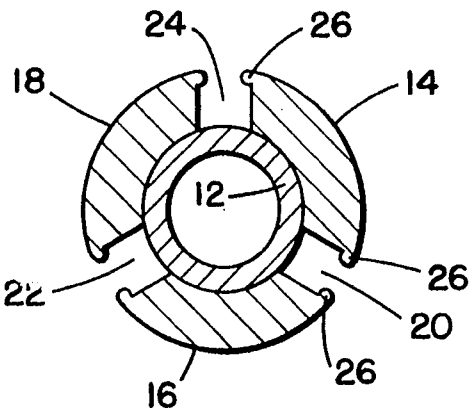
FIG. 4 is a sectional view of the core and rails of the shaft.
Figure 3:
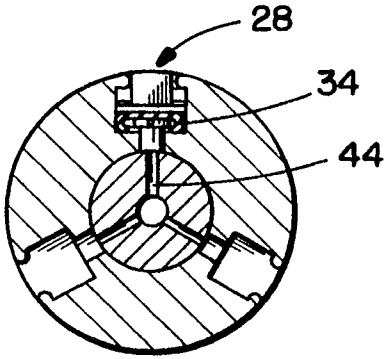
FIG. 3 is a sectional view taken on the line 3—3 of FIG. 3.

FIG. 5 illustrates the deflated condition of bladder 34 and it is seen that spring 48 is curved with the upper arm members bearing against lips 26 to urge member 30 radially inward. FIG. 6 illustrates the bladder in an inflated position with the springs 48 flattened and pressure member 28 extended radially outward.

In one fabricated unit, a shaft was constructed consisting of a filament wound tube, 3 pultruded rails and two metal journals. A filament wound tube was wound on a 1.375" diameter mandrel to an outside diameter of 2.1". The outside diameter tube was machined to 2.00" and the tube was cut to 57". The journals were then bonded into the filament wound inner tube and the rails were cut 60" long. The rails and journals were then drilled and tapped to radially locate the rails relative to the journals (one rail every 120). The outer surface of the inner tube and rail bond surfaces were lightly abraided and cleaned with solvent. The rails were then bonded using bonding adhesive. The roller sat for 24 hours prior to testing to allow the adhesive to reach maximum strength.

The testing of the roller verified the initial design and proved the concept of composite airshafts. The current metal rollers are rated to 2,000 lbs. of static load. The composite roller took 6,000 lbs. of static load without any permanent deformation or failure and very little noise was generated by the composite at the ultimate loads.

In summary, the expandable shaft of the present invention is of the slotted type and made of a composite fiber materials in which the fibers in the rails, forming the slots, extend in an elongated axial direction. The rails may be made separately and bonded to a central core or the rails and core may be formed integrally as a single unit as by pultrusion.

Having thus described the invention with particular reference to the preferred forms thereof, it will be obvious that various changes and modifications may be made therein without departing from the spirit and scope of the invention as defined in the appended claims.

What is claimed is:

1. An expandable shaft comprising a cylindrical core;

a plurality of elongated rails located on the outer surface of said core and spaced to provide slots extending parallel with the core axis;

said rails being formed of a composite fiberous material in which the fibers extend substantially parallel with the axis of said core;

elongated pressure protrusion means located within each slot and adapted to be moved radially outward;

elongated inflatable means located in each slot radially inward from the elongated pressure protrusion means to move said elongated pressure means radially outward when the elongated inflatable means inflated.

2. The expandable shaft set forth in claim 1 in which said composite fiberous material includes carbon fibers.

3. The expandable shaft set forth in claim 1 in which said composite fiberous material includes glass fibers.

4. An expandable shaft comprising

A cylindrical core;

at least three elongated rails located on the outer surface of said core and equally spaced around the circumference thereof to provide slots extending parallel with the core axis;

said core and said rails being formed of a composite material of carbon fibers in an organic matrix;

the carbon fibers of said rails extending longitudinally of the axis of said shaft;

the carbon fibers of said core extending angularly of the axis of the shaft thereby providing resistance to torsional forces;

elongated pressure protrusion means located in each slot and adapted to be moved radially outward of the shaft;

elongated inflatable means located in each slot radially inward of the elongated pressure protrusion means to move said elongated pressure means radially outward when the elongated inflatable means inflated; and conduit means within said core connected to inflate said elongated inflatable means.

5. The expandable shaft set forth in claim 4 in which the organic matrix is a thermosetting resin.

6. The expandable shaft set forth in claim 4 in which the organic matrix is thermoplastic resin.

7. An expandable shaft comprising a hollow cylindrical core;

a plurality of elongated rails bonded to the outer surface of the core and spaced to provide equally spaced slots extending parallel with the core axis;

said rails being of arcuate cross section and having a pair of lip projections at the outer surface thereof whereby each slot has two axially inwardly extending lip projections;

said core and said rails being formed of a carbon fiber and plastic resin material;

the carbon fibers of the rails extending longitudinally of the axis of said shaft whereby resistance to bending deflection is provided;

the carbon fibers of the hollow cylindrical core extending angularly of the axis of said shaft whereby resistance to torsional deflection is provided;

elongated pressure protrusion means of T-shaped cross section located in each slot and being retained therein by the said inwardly extending lip projections of each said slot;

an elongated inflatable flexible bladder means located within each slot between the bottom of the slot and the respective pressure protrusion means and adapted when inflated to move said pressure protrusion means radially outward;

leaf spring means located within each slot positioned to bear against the inwardly extending lip projections of each slot and against said T-shaped elongated pressure protrusion means to move the said protrusion means radially inward when the respective bladder means is deflated.

8. The expandable shaft set forth in claim 7 in which each said pressure protrusion means is segmented;

9. The expandable shaft set forth in claim 8 in which said leaf spring means is U-shaped and extends between segments of the pressure protrusion means.

* * * * *